United States Patent [19]

Ziolkowski

[11] Patent Number: 4,915,120

[45] Date of Patent: Apr. 10, 1990

[54] BONNET FOR LAWN CHAIRS

[76] Inventor: Philip C. Ziolkowski, 1167 N. 34th St., Springfield, Oreg. 97478

[21] Appl. No.: 325,885

[22] Filed: Mar. 20, 1989

[51] Int. Cl.[4] ..... E04H 15/58

[52] U.S. Cl. ..... 135/90; 135/117; 135/102

[58] Field of Search ..... 135/90, 117, 102, 103, 135/106, 120, 900, 96

[56] References Cited

U.S. PATENT DOCUMENTS

| | | | |
|---|---|---|---|
| 2,593,909 | 4/1984 | Moreland | 135/117 |
| 2,752,929 | 7/1956 | Berger | 135/90 |
| 2,832,361 | 4/1958 | Smith | 135/117 |
| 3,243,230 | 3/1966 | Otto | 135/90 |
| 4,440,187 | 4/1984 | Fiddler | 135/117 |
| 4,739,784 | 4/1988 | Fast | 135/117 |
| 4,785,838 | 11/1988 | Negahdari | 135/117 |
| 4,788,997 | 12/1988 | Clopton | 135/117 |

*Primary Examiner*—Carl D. Friedman
*Assistant Examiner*—Caroline D. Dennison
*Attorney, Agent, or Firm*—John F. Ingman

[57] ABSTRACT

A bonnet for lawn chairs and the like involves a canopy formed of a plurality of flexible, resilient bows, which are maintained in a generally U-shaped configuration, and a flexible covering attached to and interconnecting the bows along a substantial portion of their length. The bows are attached to a chair through two bow assembly bars, each of which have a separate attachment location, in linear spaced relationship, for each bow. Each bow is pivotally connected, with adjustable tension, at its ends between the two bow assembly bars at the separate spaced locations so as to permit each of the bows to be individually pivotable, fore and aft, thereby permitting variation of the canopy coverage and location. The bow assembly bars are removably clamped to the framework on opposing sides of a lawn chair. A flexible line, of less length than the bows, is used to directly interconnect the bow assembly bars so as to restrain the resilient bows to a generally U-shaped configuration. Connection of the end of a bow, which is preferably formed of oil tempered wire, to a bow assembly bar may utilize a bow holder formed of an elongated piece of rigid material where, at one end, a hole is longitudinally formed, and the end of a bow secured therein, while, at the other end of the bow holder, a transverse hole is formed through the bow holder for pivotal pin attachment to the bow assembly bar.

3 Claims, 2 Drawing Sheets

BONNET FOR LAWN CHAIRS

BACKGROUND OF THE INVENTION

1. Field of the Invention

This invention involves a bonnet or covering for lawn chairs and the like, which provides adjustable protection to the occupant from sun or rain.

2. Description of the Prior Art

Certain sun shades have been designed to permit sunbathing on lounge chairs which recline to the horizontal, so as to protect portions of the body, such as the head or midriff, while achieving a sun tan. Such sun shades, however, are not suitable for people sitting in lawn chairs or other outdoor furniture who desire to be protected from the elements, either sun or rain, such as those hunting or fishing, spectators at sports events, or simply fresh air enthusiasts who otherwise desire shelter.

What is needed is a bonnet for lawn chairs, and the like, which:

- is lightweight, easily foldable, transportable, and storable with the chair;
- fits a range of chair widths, and is simple to install and remove; and
- provides effective and easily adjustable protection against both sun and rain.

SUMMARY OF THE INVENTION

The present invention provides a bonnet for lawn chairs and the like which is designed to satisfy the aforementioned needs. The invention involves a canopy formed of a plurality of, preferably four, flexible, resilient bows, which are maintained in a generally U-shaped configuration, and a flexible covering attached to and interconnecting the bows along a substantial portion of their length. The bows are attached to a chair through two bow assembly bars, each of which have a separate attachment location, in linear spaced relationship, for each bow. Each bow is pivotally connected, with adjustable tension, at its ends between the two bow assembly bars at the separate spaced locations, so as to permit each of the bows to be individually pivotable, fore and aft, thereby permitting variation of the canopy coverage and location The bow assembly bars are removably clamped to the framework on opposing sides of a lawn chair. A flexible line, of less length than the bows, is used to directly interconnect the bow assembly bars so as to restrain the resilient bows to a generally U-shaped configuration, thereby facilitating installation and storage of the bonnet. Connection of the end of a bow, which is preferably formed of oil tempered wire, to a bow assembly bar may utilize a bow holder formed of an elongated piece of rigid material where, at one end, a hole is longitudinally formed, and the end of a bow is secured therein, as by swaging, while at the other end of the bow holder, a transverse hole is formed for pivotal pin attachment to the bow assembly bar.

DESCRIPTION OF THE PREFERRED EMBODIMENT

Figure 1:
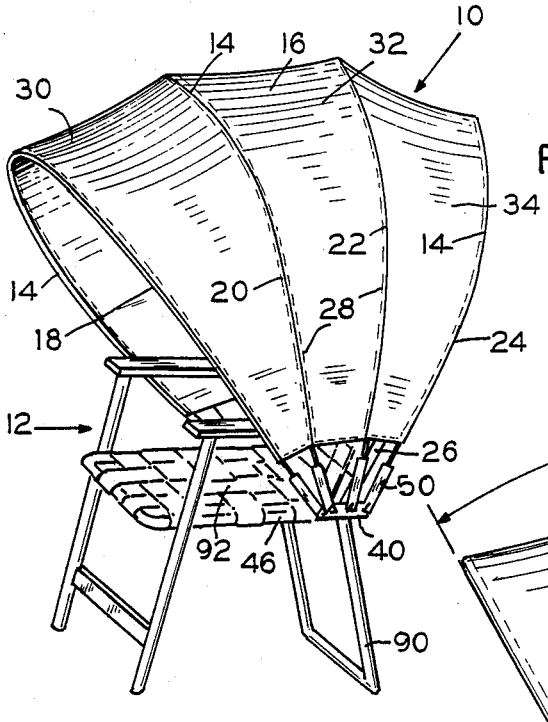
FIG. 1 illustrates a perspective view of the bonnet for lawn chairs, as mounted on a lawn chair.
Figure 2:
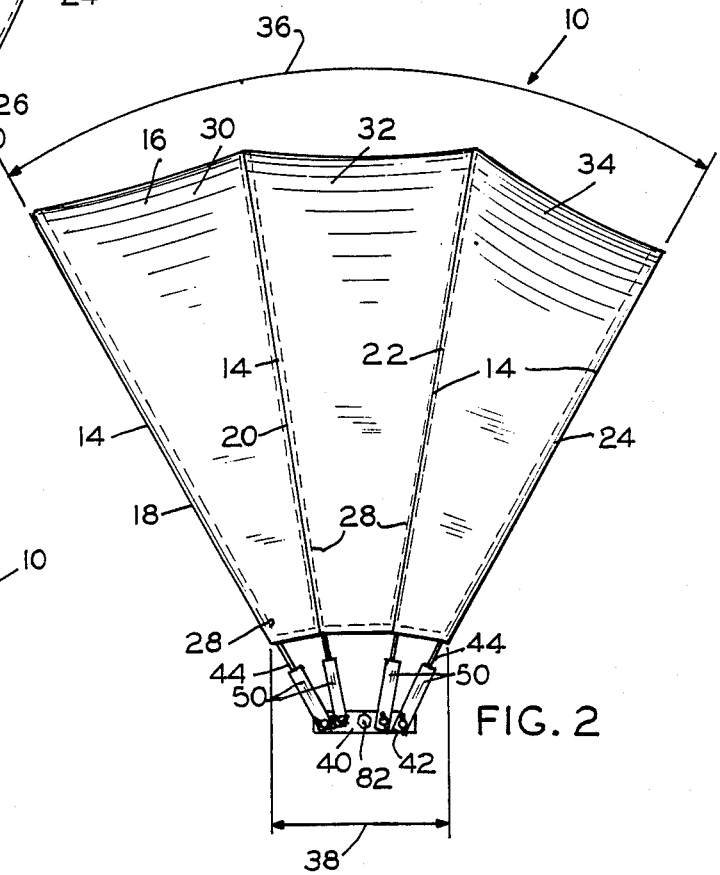
FIG. 2 illustrates a side view of an opened bonnet, separate from the lawn chair.

Referring now to the drawings, there is shown in FIG. 1 the preferred embodiment of the bonnet 10, as typically mounted on a folding lawn chair 12. The bonnet 10 includes a plurality of flexible, resilient bows 14, retained in a generally U-shaped configuration, and a flexible covering 16 attached to, and interconnecting, the bows 14 along a substantial portion of their length.

In the preferred embodiment, there are four bows 14, the front three bows 18, 20, and 22 having a length of approximately 76-inches, while the rearmost bow 24 is only approximately 72-inches long, the shorter length of the rearmost bow 24 enhancing the ability of the bonnet 10 to be folded into a compact package, and also providing a tighter protective fit to the proximity of the back 26 of the chair 12. A preferred material for the bows 14 is a 0.120-inch oil tempered wire which is lightweight and has the excellent resilience necessary to retain the U-shaped configuration of the bonnet 10. Other bow materials may also be satisfactory, such as $\frac{1}{4}$-inch nylon rods, as used with certain tenting.

The covering 16, extending between the bows 14, should also be flexible and lightweight, and impervious to sun and rain, a single layer of urethane-coated ripstop nylon working well. Attachment of the covering 16 to the bows 14 is by conventional means, such as sewing 28 so that the bows 14 and bow holders 50, described subsequently, can be easily slipped out, and the covering cleaned. With the preferred four bows 14, three separate panels 30, 32 and 34 of covering 16 may be used, with the central panel 32 of contrasting color, so as to form an attractive set of alternating colors, such as school colors. When the intended application of the bonnet 10 is in conjunction with hunting or fishing, a camouflage pattern (not shown) on the material of the covering 16 would be appropriate. In the preferred embodiment, each panel 30, 32, 34 tapers from an effective width of approximately 14-inches at the top to a lower side width of approximately 4-inches, so that, with a three panel covering, a total top coverage 36 of approximately 42-inches, and a bottom side coverage 38 of approximately 12-inches is provided.

Two bow assembly bars 40 are used to provide individual separate attachment locations 42 for the ends 44 of the bows 14. Separate, spaced attachment locations 42 are used to provide the capability for individual adjustment of the orientation of each of the bows 14, for strength, and, importantly, to permit a broader juncture of the bows 14 so as to provide increased width of the covering 16 at the sides 46 of the chair 12 for better protection from sun or rain.

Figure 5:
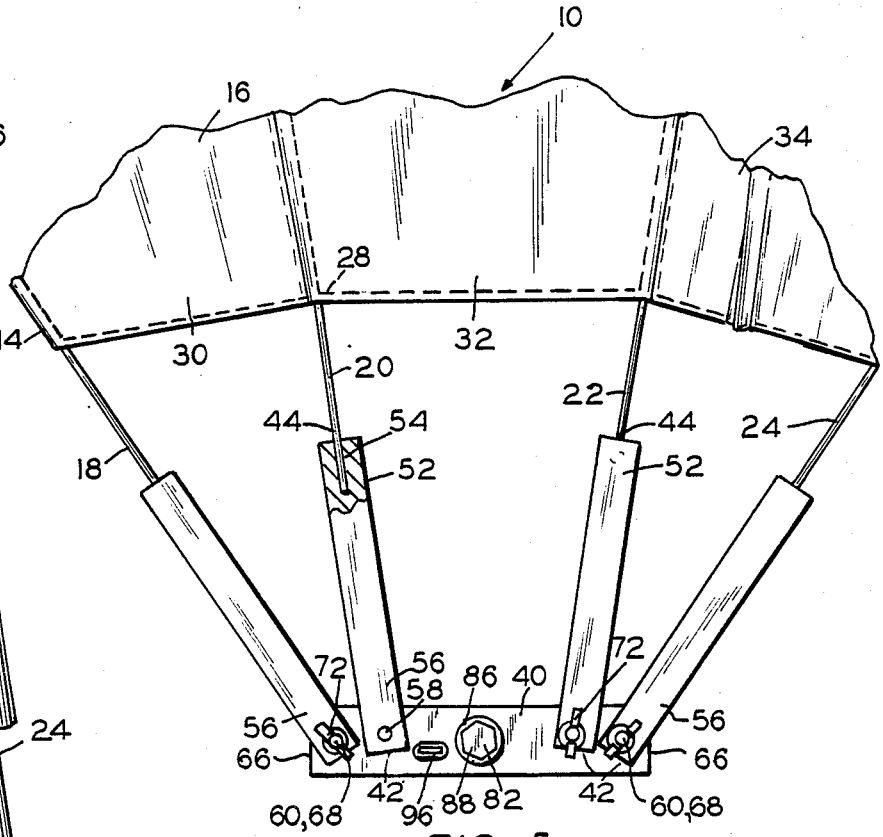
FIG. 5 illustrates an enlarged side view of the bow assembly bar and associated components of the bonnet.
Figure 7:
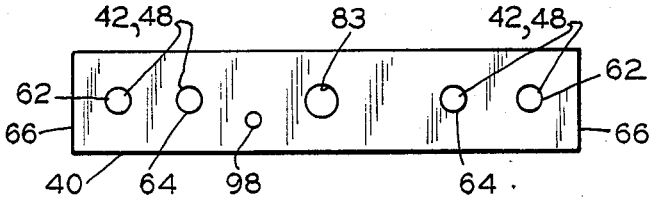
FIG. 7 illustrates an unattached bow assembly bar, showing the attachment positions formed therein.

A preferred bow assembly bar 40, as best seen in FIGS. 5 and 7 is a straight, rigid bar, approximatety $4\frac{1}{2}$-inches in length, having four holes 48 linearly spaced therein, as the attachment locations 42, corresponding to the four bows 14. A preferred means of connection of the end 44 of a bow 14 to the bow assembly bar 40, when the bows 14 are formed of oil-tempered wire, involves a bow holder 50 formed of an elongated piece of rigid metal, such as aluminum, approximately 4-inches long and ½-inch wide. At one end 52 of the bow holder 50 a longitudinal hole 54 is formed, and with the end 44 of a bow 14 placed in the hole 54, the bow holder 50 may be swaged to retain the bow end 44 in connection with the bow holder 50. At the other end 56 of the bow holder 50, a transverse hole 58 is formed, for pivotal pin member 60 attachment through a hole 48 in the bow assembly bar 40. Using the described bow holder 50, with a bow assembly bar 40 of 4½-inches in length, a hole 48 placement of the two outer holes 62 centered at ⅜-inch, and the inner holes 64 centered 1⅛-inch, from the ends 66 of the bow assembly bar 40, provides adequate space for pivotal movement.

As indicated above, each of the two bow assembly bars 40 have a separate attachment location, in linear spaced relationship, for each bow 14, so that one of the ends 44 of each bow 14, extended by the bow holder 50, or other bow attaching assembly, connects to an attachment location 42 on one of the bow assembly bars 40, and the other end of that bow 14, through its bow holder 50, or other bow attaching assembly, connects to the opposing attachment location 42 on the other bow assembly bar 40. Each of the bows 14, attached between the two bow assembly bars 40, are connected thereto with a pin member 60, so that each of the bows 14 are pivotable, fore and aft, about the pin members 60 so as to be adjustable in orientation relative to the bow assembly bar 40 and to each of the other bows 14, also pivotally attached at their attaching locations. The individual pivoting of the bows 14 allows each bow 14 to be positioned so as to provide the amount of coverage from sun and rain as the user desires. Upon achieving the desired position of each bow 14, its bow holders 50 may be adjustably tensioned into that position. A simple manner of tension adjustment is through the use of a threaded bolt 68, which also acts as the pin member 60, a spacer 70, a nut 72, and star washers 74, where tightenig of the nut 72 will, in conjunction with the star washers 74, press the bow holder 50, through spacer 70 against the bow assembly bar 40, and thus hold the bow 14 in position. Hard tightness may be imposed, thereby firmly locking a bow holder 50 in position, while only moderate tightness will permit pressure against a bow 14 to move a bow holder 50 to a new orientation, yet providing sufficient tension to retain the bow 14 at the new location under ordinary circumstances of use. A preferred manner of tightening in normal use is to moderately tighten the nuts 72 on the bow holders 50 for the front bow 18 and rear bow 24, while the two intermediate bows 20 and 22 are left slightly looser so as to easily follow, by tension through the covering the movement of the front bow 18 and rear bow 4. For such an arrangement, it is desirable to utilize nuts 72 in the form of wing nuts or similarly easy-to-handle nuts, for at least the bolts 68 controlling the position of the front bow 18 and the rear bow 24.

Figure 6:
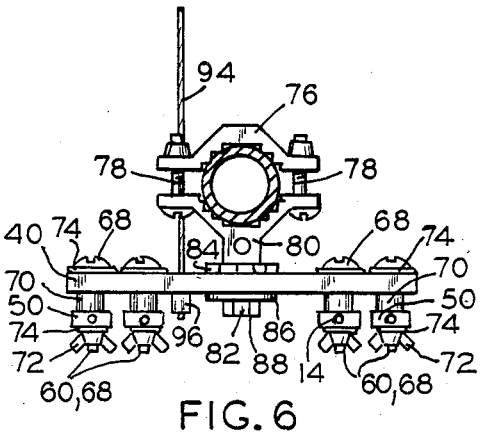
FIG. 6 illustrates a top view of a connection of a bow assembly bar to the framework of a lawn chair.
Figure 4:
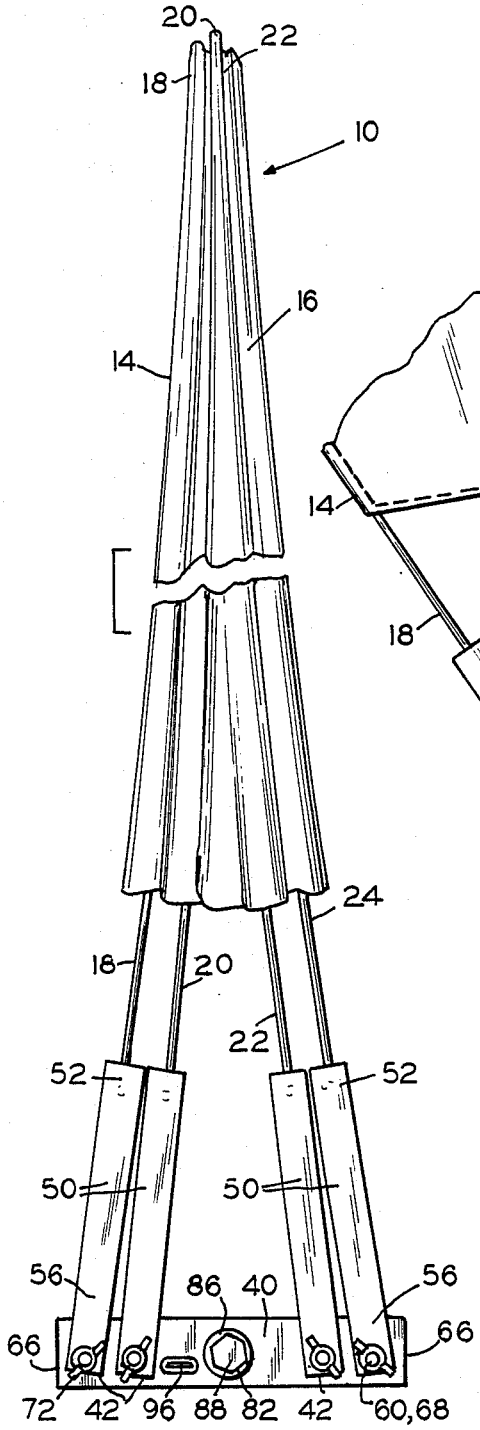
FIG. 4 illustrates a side view of a closed bonnet, separate from the lawn chair.

Attachment of the bow assembly bars 40 to the framework of the chair 12 may be accomplished in a variety of manners. Preferred for its simplicity, low cost, and ease of installation, since it requires no modification to the chair 12, is the use of a conventional pipe clamp 76, with opposing bolts 78, as best seen in FIG. 6. The threaded extending head 80 of the pipe clamp 76 is centrally attached to the bow assembly bar 40 by means of a threaded bolt 82 extending through the centrally formed hole 83 in the bow assembly bar 40 and two star washers 84 and 86. In the preferred configuration, star washer 84 is larger, to fit over the extending head 80 of the pipe clamp 76, while star washer 86 is smaller to fit the head 88 of the bolt 82. While the bow assembly bar 40 may be attached to the chair 12 in a number of locations, a preferred location is along the upwardly extending rear leg 90, proximate to seat 92 level, although other locations may also be appropriate, depending on the design of the chair 12 and the coverage desired. At attachment, the length of the bow assembly bar 40 is substantially horizontal and is tightened firmly into that position, so that, as illustrated, the bows 14 extend upwardly from substantially the same level to support the covering 16.

Figure 3:
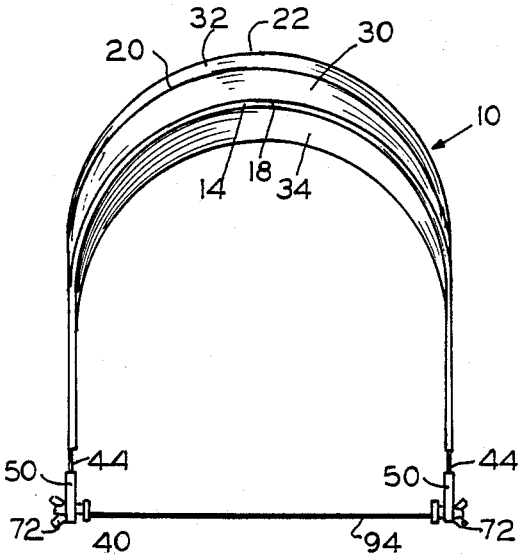
FIG. 3 illustrates a front view of the bonnet of FIG. 2.

As best seen in FIG. 3, a flexible line 94, of substantially less length that the length of the bows 14 plus bow holders 50, is formed to interconnect the bow assembly bars 40 so as as to restrain them more closely together and thereby cause the resilient bows 14 to maintain their generally U-shaped configuration. Since the bows 14, when free, tend to straighten out, the pre-shaping of the bonnet 10 by the use of the line 94 greatly facilitates installation of the bonnet 10 on chair 12, and also is beneficial in the handling and storage of the bonnet 10, particularly if it has been removed from the chair 12 A suitable restrained spacing of the bow assembly bars 40 has been found to be 26-inches which is approximately 3-inches greater than the width of most conventional lawn chairs. The bonnet 10 therefore is easily installable on most lawn chairs 12 having a width of less than the length of line 94. The use of coated 18 gauge wire for line 94, in conjunction with press ferrules 96, where the line 94 has been passed through holes 98 formed in the bow assembly bars 40, works well. The line 94 is designed to permanently remain with the bonnet 10, and should not be removed after initial installation of the bonnet IO on a lawn chair 12, the line 94 conveniently fitting beneath the seat 92 and forward of the rear leg 90 in the illustrated preferred mounting to the chair 12.

In use, any of the individually adjustable bows 14 may be separated to provide maximum coverage, or brought together to reduce coverage. Any of the separate panels 30, 32 or 34 can be collapsed by pivoting and relocating together the respective bows 14 which support that panel. As may be readily appreciated, a variety of positions and extents of coverage may be obtained by adjusting the positions of the individuals bows 14. For minimum coverage, all of the bows 14 may be pivoted together and aligned with the back 26 of the chair 12; in this configuration, the lawn chair 12 also may be folded up in the conventional manner and stored with the mounted bonnet 10, in only a slightly greater space than required for the chair 12 alone As noted previously, the rearmost bow 24 is of shorter length to nest with the remaining bows.

It is thought that the bonnet for lawn chairs of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A bonnet for lawn chairs and the like, which comprises:

a. a plurality of flexible resilient bows of generally U-shaped configuration;

b. a flexible covering attached to and interconnecting said bows along a substantial portion of their length;

c. two bow assembly bars, each having a separate attachment location, in linear spaced relationship, for each bow;

d. means for connecting, with individually adjustable tension, one of the ends of each bow to one of said bow assembly bars and the other end of each bow to the other of said bow assembly bars, so as to permit each of the bows, extending between the bow assembly bars, to be pivotable relative to the bow assembly bars and to each other a separate spaced locations, thereby permitting variation in canopy coverage and location; and e. means for attaching the bow assembly bars to a chair framework.

2. The bonnet for lawn chairs and the like, as recited in claim 1, wherein, additionally, there is a flexible line, of less length than the bows, which is attached to and formed to interconnect the bow assembly bars so as to restrain the resilient bows to a generally U-shaped configuration, thereby facilitating installation and storage of said bonnet.

3. The bonnet for lawn chairs and the like, as recited in claim 1, where the bows are formed of oil tempered wire and the means of connecting the end of a bow to said bow assembly bars includes a bow holder formed of an elongated piece of rigid material where, at one end, a hole is longitudinally formed, and the end of a bow is secured therein, and where, in the other end of said bow holder, a transverse hole is formed through said bow holder for pivotal pin attachment to said bow assembly bar.

* * * * *